US005753072A

United States Patent [19]

Taylor

[11] Patent Number: 5,753,072

[45] Date of Patent: May 19, 1998

[54] LABEL APPLICATOR AND METHOD OF MAKING SAME

[75] Inventor: Bruce W. Taylor, Tipp City, Ohio

[73] Assignee: Monarch Marking Systems, Inc., Dayton, Ohio

[21] Appl. No.: 463,600

[22] Filed: Jun. 5, 1995

[51] Int. Cl.[6] ..... B65C 9/00

[52] U.S. Cl. ..... 156/493; 156/541; 156/542; 156/DIG. 31

[58] Field of Search ..... 156/493, 541, 156/542, DIG. 31

[56] References Cited

U.S. PATENT DOCUMENTS

| | | | |
|---|---|---|---|
| 3,885,705 | 5/1975 | French | 221/211 |
| 3,984,277 | 10/1976 | French et al. | 156/497 |
| 4,392,913 | 7/1983 | Baumli | 156/584 |
| 4,526,648 | 7/1985 | Tochtermann | 156/497 |
| 4,680,082 | 7/1987 | Kearney | 156/497 |

*Primary Examiner*—Krisanne Thornton

*Attorney, Agent, or Firm*—Joseph J. Grass

[57] ABSTRACT

There is disclosed a label applying machine including a label applicator having a mounting plate and a resilient pad with selectively positionable vacuum buttons to hold labels of different sizes (lengths and widths) onto the label applicator by vacuum.

9 Claims, 6 Drawing Sheets

FIG-9

| LABEL SIZE WIDTH X LENGTH (IN INCHES) | HOLE POSITIONS FOR VACUUM BUTTONS 38 | HOLE POSITIONS FOR VACUUM BUTTONS 38' |
|---|---|---|
| 4 X 5 | A, C, S, Z | -- |
| 3 X 5 | A, C, L, R | S, Z |
| 2 X 5 | A, C, H, K | S, Z |
| 4 X 4 | B, C, T, Z | A, S |
| 3 X 4 | B, C, M, R | A, S, Z |
| 2 X 4 | B, C, H, K | A, S, Z |
| 4 X 3 | D, C, W, Z | A, S |
| 3 X 3 | C, D, N, R | A, S, Z |
| 2 X 3 | C, K, D | A, S, Z |
| 1.2 X 3 | C. D. F | A, S, Z |
| 4 X 2 | C, E, X, Z | A, S, Z |
| 3 X 2 | C, E, P, R | A, S, Z |
| 2 X 2 | C, E, J, K | A, S, Z |
| 1.2 X 2.2 | E, C, F | A, S, Z |
| 4 X 1.2 | C, K, Z | A, S |
| 3 X 1.2 | C, R | A, S |
| 2 X 1.2 | C, K | A, S |

LABEL APPLICATOR AND METHOD OF MAKING SAME

BACKGROUND OF THE INVENTION

1. Field of the Invention

This invention relates to the art of label applying machines and to methods of making label applicators.

2. Brief Description of the Prior Art

Label applying machines of the type to which the invention is directed are well known in the art. In particular, a label applicator as shown in FIGS. 10 and 11 is known, however, it is limited to holding and applying substantially one size label because placement of various vacuum buttons is limited to preset locations.

Various U.S. Pat. Nos. 3,885,705; 3,984,277; 4,392,913; 4,526,648 and 4,680,082 are made of record.

SUMMARY OF THE INVENTION

It is a feature of the invention to provide an improved label applicator which is useful in holding and applying a variety of labels of substantially different sizes.

The improved label applicator of the invention is provided with a plurality of vacuum buttons which are selectively positionable through a resilient pad in accordance with the size of the label to be held and applied by the label applicator. In accordance with a specific embodiment of the invention, a mounting plate is provided with a series of holes for receiving vacuum buttons. The vacuum buttons are connected to a source of vacuum. The number of holes in the plate is greater than the number of vacuum buttons. The vacuum buttons are fitted into selected holes according to the size of the label which is to be held by the vacuum buttons. The vacuum buttons also fit through holes in a resilient applicator pad. It is preferred to cut holes in the resilient pad following a determination as to the size of the label to be held. It is also preferred to make the vacuum buttons in two portions or pieces which can be readily connected to each other for ease of assembly through the mounting plate and the resilient pad. The vacuum buttons serve to hold the mounting plate and pad to each other. In that the number of vacuum buttons which are connected to the vacuum source may be insufficient to hold the resilient pad to the mounting plate, additional buttons not connected to any vacuum source can be used as fasteners to hold the resilient pad to the mounting plate.

BRIEF DESCRIPTION OF THE DRAWINGS

FIG. 9 is a chart showing the positioning of the buttons for various label sizes;

DETAILED DESCRIPTION OF THE PREFERRED EMBODIMENTS

Figure 1:
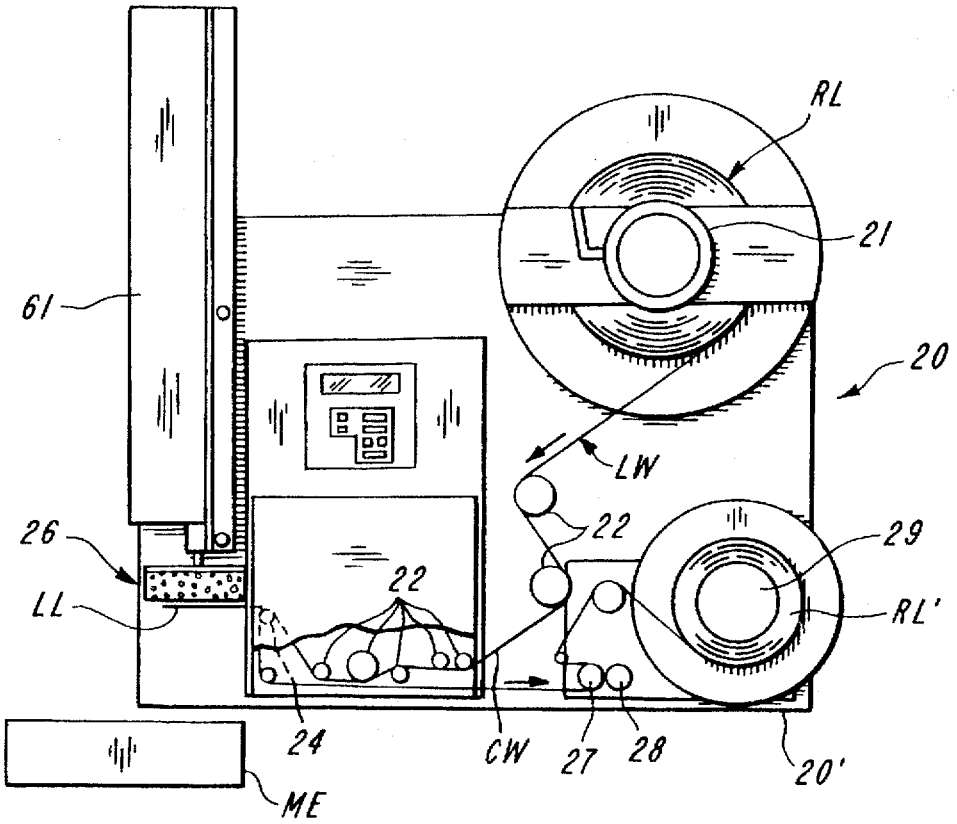
FIG. 1 is a side elevational view of a label applying machine with the improved label applicator.
Figure 2:
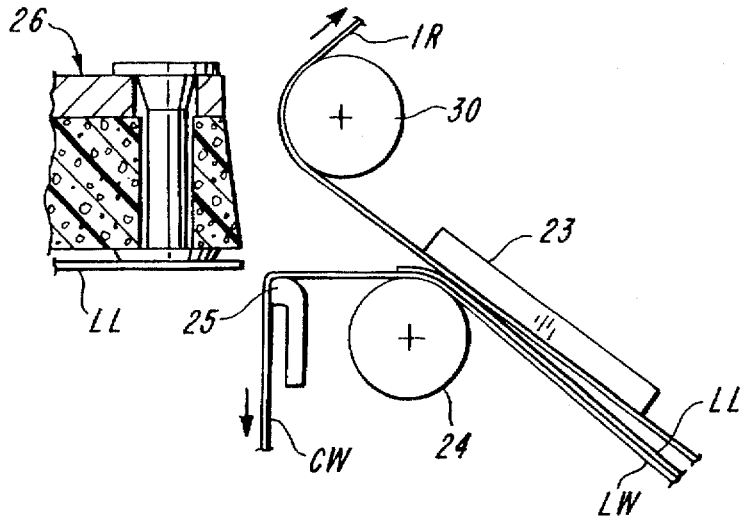
FIG. 2 is a fragmentary view of portions of the machine including the label applicator.

With reference to FIG. 1, there is shown a label applying machine generally indicated at 20. The machine 20 has a frame 20' which can be mounted in any convenient orientation with respect to merchandise ME to be labeled. The machine 20 includes a mounting member 21 for mounting or supporting a roll RL of the label web LW composed of a carrier web CW to which labels LL are releasably adhered. The label web LW passes from the roll RL into contact with various guide rollers 22 to between the print head assembly 23 and a platen roll 24 (FIG. 2). From there the web LW passes to a delaminator 25 where the carrier web CW is caused to undergo a sharp change of direction, thereby causing the leading label LL to be delaminated as the carrier web CW is advanced. The leading label LL is dispensed into underlying relationship to a label applicator generally indicated at 26. The carrier web CW is guided to between a driven roll 27 and a back-up roll 28. From there the carrier web CW is guided to a take-up roll 29 and is wound into a roll RL'.

When a label LL has been dispensed into underlying relationship with respect to the label applicator 26, the label LL is held to the underside of label applicator 26 by vacuum. When the label LL is ready to be applied to the merchandise ME, an air cylinder (not shown) is operated to move the label applicator 26 and the label LL which it carries toward the merchandise ME. The label applicator 26 presses or applies the label LL onto merchandise ME.

The label applying machine 20 can print directly onto thermally sensitive labels LL or it can transfer ink onto plain labels LL using a thermal ink ribbon IR. As shown in FIG. 2, the ribbon IR passes between the print head assembly 23 and the platen roll 24 and from there is guided by a roller 30.

Figure 3:
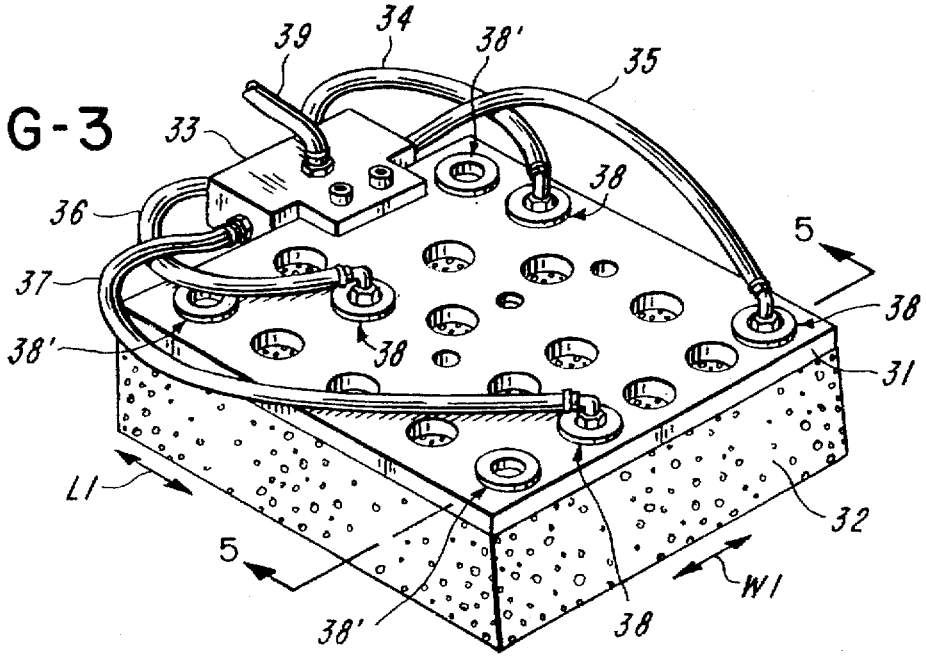
FIG. 3 is a perspective view of the label applicator.

Referring to FIG. 3, the label applicator 26 is shown to have a mounting plate 31, a resilient pad 32, a manifold 33 and flexible elastomeric tubes 34, 35, 36 and 37 connecting the manifold 33 and vacuum buttons or ducts 38. A source of vacuum (not shown) is connected to the manifold by a flexible elastomeric tube 39.

Figure 5:
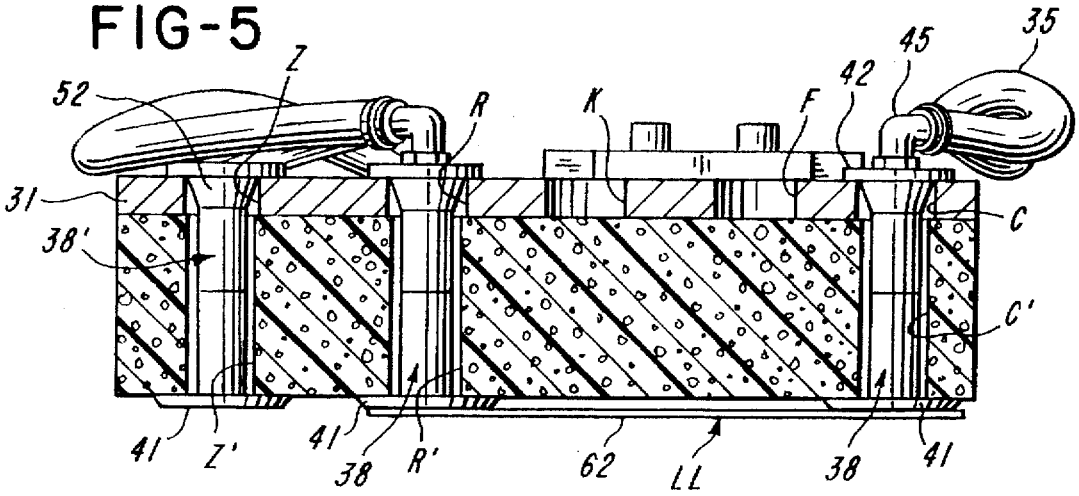
FIG. 5 is an enlarged sectional view taken generally along line 5—5 of FIG. 3, showing the buttons in elevation.
Figure 6:
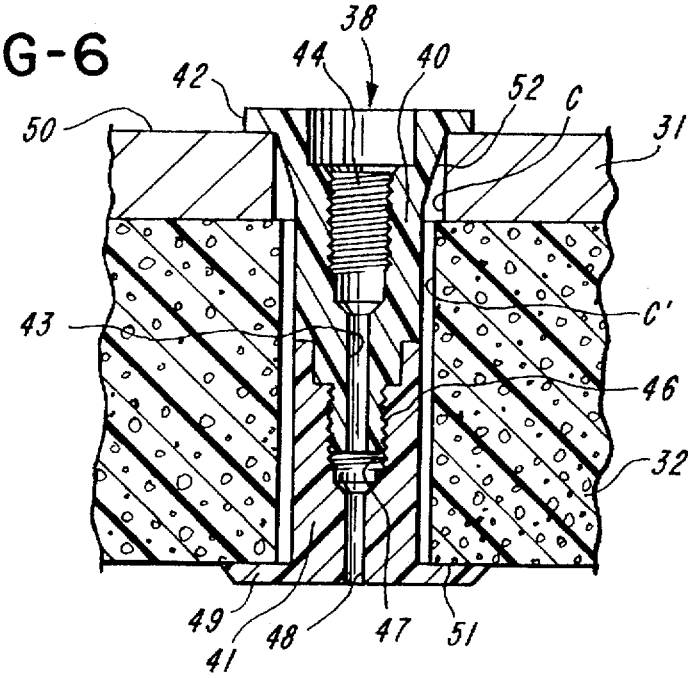
FIG. 6 is an enlarged sectional view showing one of the vacuum buttons in section and in relation to the mounting plate and the resilient pad.

The structure of one of the vacuum buttons 38 is best shown in FIGS. 5 and 6. The vacuum buttons 38 are shown to be comprised of button portions 40 and 41. The button portion 40 has a head 42 and a passage 43 with an internally threaded bore 44. The threaded bore 44 threadably receives a fitting 45 connected to the tube 35. The button portion 40 has an externally threaded stub end 46 which is threadably received in an internally threaded bore 47. The passage 43 communicates with a passage 48 in the button portion 41. The button portion 41 has a head 49. The head 42 abuts against the upper surface 50 of the mounting plate 31 and the head 49 abuts against lower surface 51 of the resilient pad 32.

As shown, the hole C' in the resilient pad 32 is slightly larger than the outer diameter of the vacuum button 38. Upper surface 52 of the button portion 40 is tapered upwardly and outwardly in a generally frustro-conical manner. The upper end of the surface 52 is essentially the same size as a hole C in the mounting plate 31 so as to center the vacuum button in the hole C. However, the surface 52 enables the vacuum button 38 to move upwardly relative to the plate 31 without binding when the label applicator 26 presses the label LL onto the merchandise ME. In so doing, the resilient pad 32 also compresses.

Figure 4:
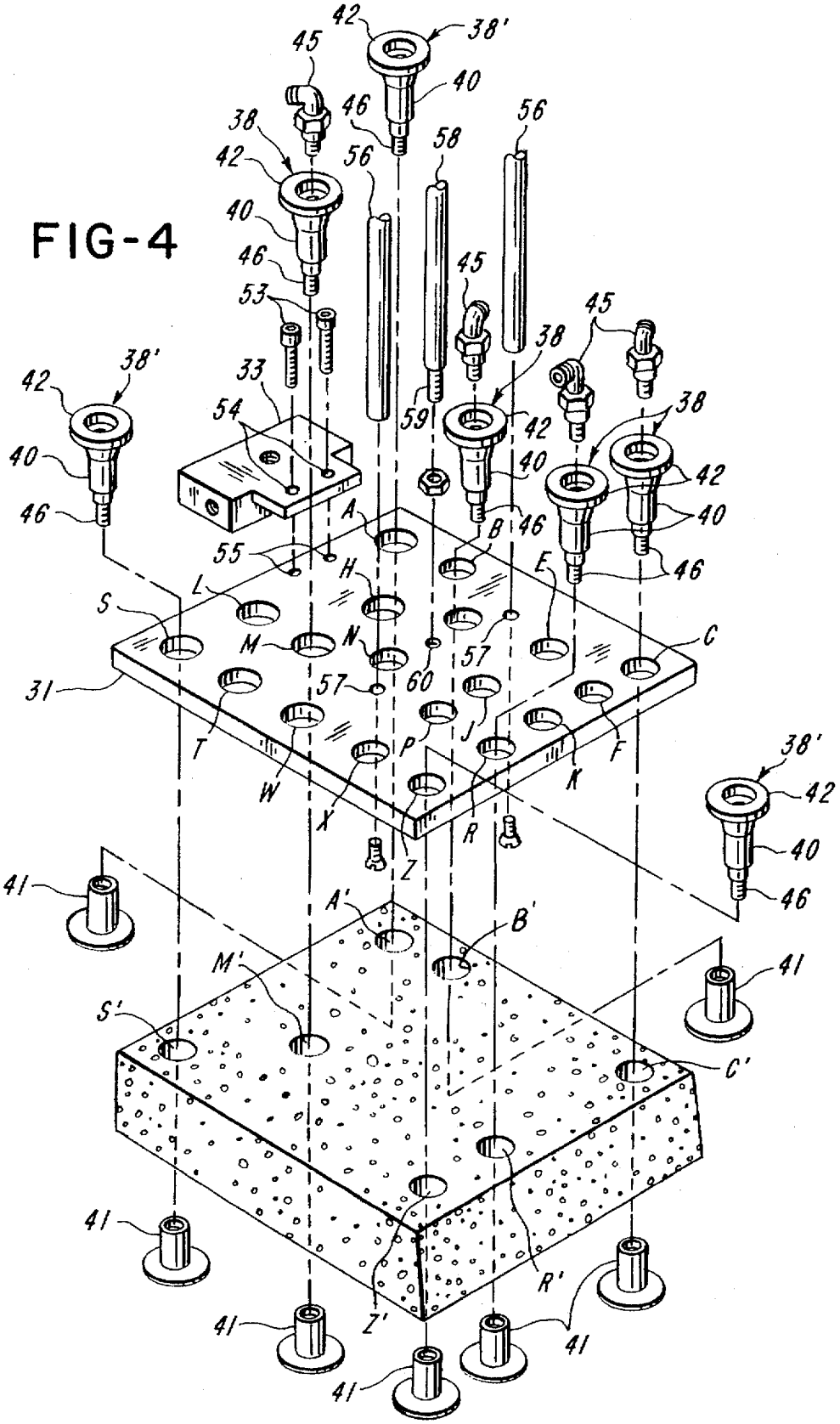
FIG. 4 is an exploded perspective view of the label applicator and portions of the label applying machine.

As shown in FIG. 4, the manifold 33 is secured to the plate 31 by screws 53 passing through holes 54. The screws 53 are received in threaded holes 55 in the mounting plate 31. Guide rods 56 received in holes 57 guide the plate 31 for straight line movement. An actuator 58 has a threaded end portion 59 received in a threaded hole 60 in the mounting plate 31. The actuator 58 is moved (vertically as shown in FIG. 1) by an air cylinder (not shown) within a housing 61. The actuator 58 moves the label applicator 26 into label applying relationship with the merchandise ME. The underside of the label LL has a coating of pressure sensitive adhesive 62 (FIG. 5) so that when the label LL is pressed onto the merchandise ME, the adhesive 62 adheres the label to the merchandise ME. The holding force of the adhesive 62 is greater than the vacuum applied by the vacuum buttons 38 to the upper surface of the label LL. Therefore, as the label applicator 26 moves away from the merchandise ME the vacuum holding action exerted on the label LL is broken. It is noted that the vacuum applied to the vacuum buttons 38 is continuous as is preferred, however, the vacuum can be interrupted once the label has been applied until such time as another label LL is dispensed into underlying relation to the label applicator 26.

Buttons 38' are used to assure that the resilient pad 32 is held securely onto the plate 31. The buttons 38 and 38' are identical. Accordingly, the same reference characters are applied to the component parts of the buttons 38' as are applied to the vacuum buttons 38. No vacuum is applied to the buttons 38'. The buttons 38' hold the resilient pad 31 to the plate 32 so that a flat surface exists at the underside of the pad 32, but the buttons 38' do not have any label-holding function.

In the embodiment of FIGS. 1 through 6, the vacuum buttons 38 are received in holes or hole positions B, C, M and R and the buttons 38' are received in holes or hole positions A, S and Z. The hole positions B, C, M and R have been selected to correspond to (or fit) a label L of a particular size. It is noted that the resilient pad 32 has been provided with cutouts or holes A', B', C', M', R', S' and Z' aligned with the holes A, B, C, M, R, S and Z in the plate 31. The hole-cutting in the resilient pad 32 can be accomplished by any suitable means.

Figure 7:
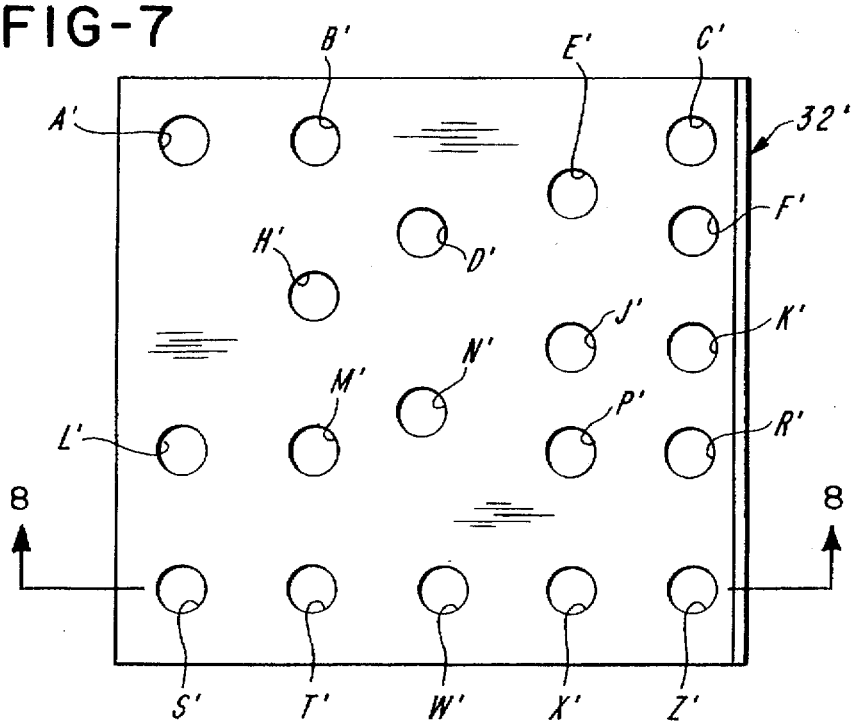
FIG. 7 is a top plan view of the resilient pad showing the different selected locations wherein the buttons can be used either actively (with vacuum) or passively (without vacuum)
Figure 8:
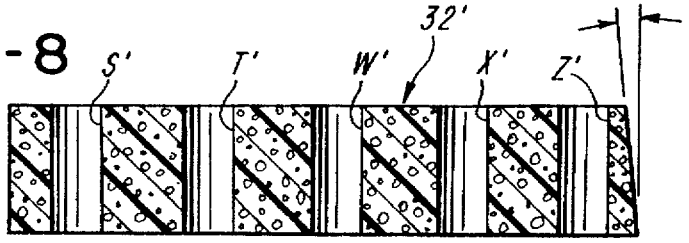
FIG. 8 is a sectional view taken generally along line 8—8 of FIG. 7.

In the embodiment of FIGS. 7 through 9, there is shown a resilient pad 32' which is like the resilient pad 32 in construction, function and use, except that the pad 32' has a hole at the same position as every hole in the plate 31. This embodiment serves to depict the various hole positions for substantially different size labels. More particularly, the resilient pad has holes or hole positions A', B', C', D', E', F', H', J', K', L', M', N', P', R', S', T', W', X' and Z' corresponding to and aligned with respective holes or hole positions A, B, C, D, E, F, H, J, K, L, M, N, P, R, S, T, W, X and Z. FIG. 9 shows a chart of the different hole positions which are preferred to be used for buttons 38 and 38' for different size labels LL. Label length is in the direction of arrow L1 and label width is in the direction of arrow W1 as indicated in FIG. 3. For example, for a label LL which is 3 inches wide and 4 inches long, vacuum buttons 38 are positioned at hole positions B, C, M and R in the plate 31, and buttons 38' are positioned at hole positions A, S and Z. This corresponds to the embodiment of FIGS. 1 through 6. If, however, a label 1.2 inches wide by 3 inches long is to be applied, then vacuum buttons 38 would be positioned at holes or hole positions C, D and F in the plate 31 and buttons 38' would be positioned at holes or hole positions A, S and Z.

It is preferred that holes be cut in the resilient pad 32 (or 32') at only such locations or positions as are actually used so as to maintain the integrity of the pad and also to minimize the tendency of a corner of the label to catch in the hole with possible misregistration of the label LL. The applicator pad 32' as illustrated in FIGS. 7 and 8 has holes at every aligned position in which there is a hole in the plate 31. Alternatively, the number of holes in the pad 32 or 32' can be selected to be less than the number of holes in the plate 31 but greater than the number required for a particular size label.

While it has been found effective to essentially use the buttons 38' as fasteners which fasten or connect or hold the pad 32 (or 32') to the plate 31, other suitable fasteners (not shown) which allow the resilient pad to deflect or compress can be used.

Figure 10:
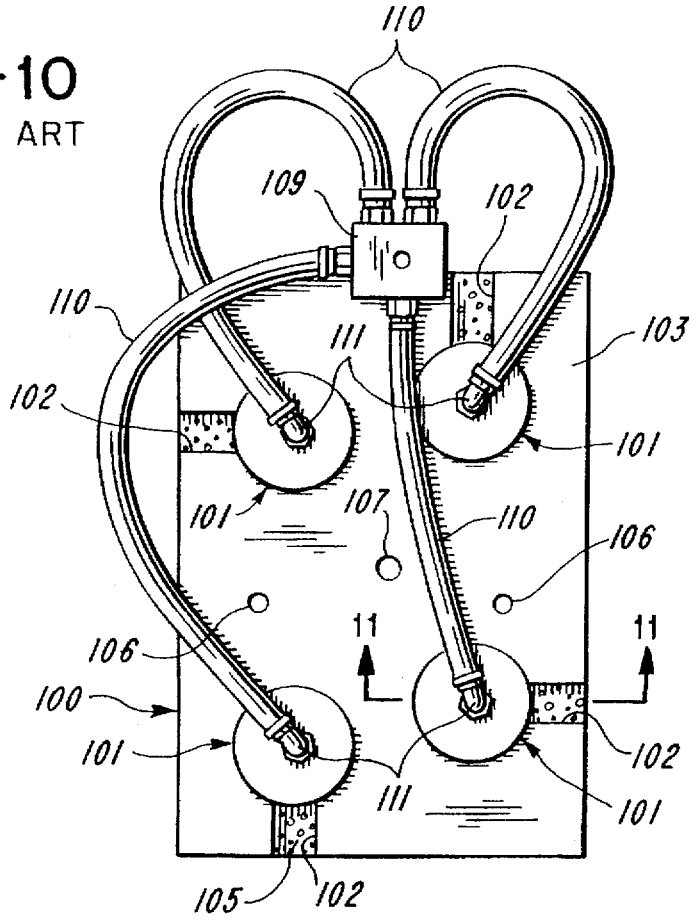
FIG-10 PRIOR ART
FIG. 10 is a top plan view showing a prior art label applicator.
Figure 11:
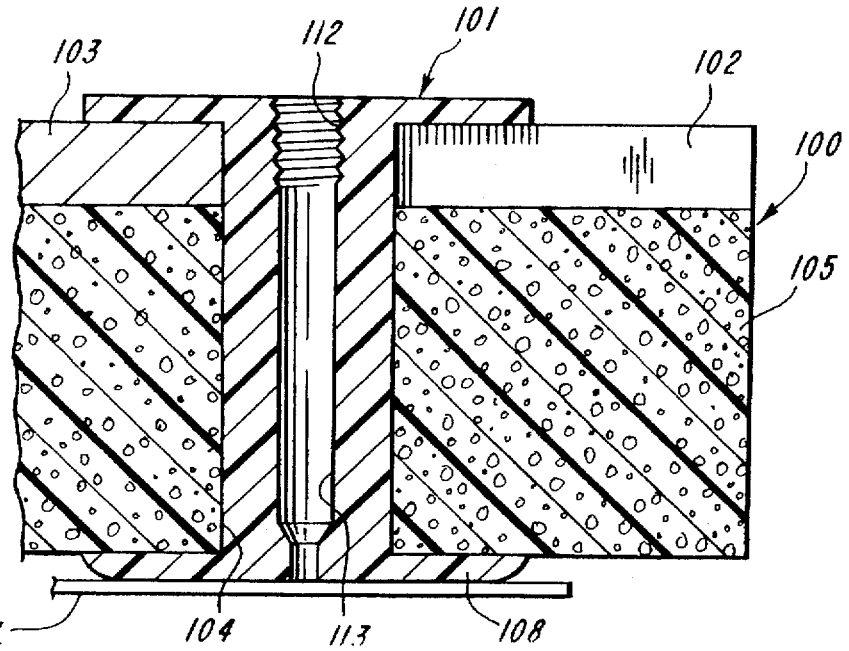
FIG-11 PRIOR ART
FIG. 11 is a sectional view taken generally along line 11—11 of FIG. 10.

FIGS. 10 and 11 show a prior art label applicator 100 used with the label applying machine depicted in FIG. 1, over which the label applicator 26 of the invention is an improvement. The applicator 100 has one-piece vacuum buttons 101 which extend through slots 102 in a metal plate 103 and through holes 104 in the resilient pad 105. Holes 106 corresponding to holes 57 are for receiving guide rods 56 (FIG. 4) and a threaded hole 107 corresponds to the hole 60. In order to make the label applicator 100, slots 102 are cut in the plate 103, and holes 104 are cut in the resilient pad 105. The resilient pad 105 is spread so that heads 108 of the vacuum buttons 101 can be inserted through the holes 104. The pad 105 is stretched so that the vacuum buttons 101 can be inserted through the slots 102 into the positions shown in FIG. 10. No additional buttons or holes are provided to fasten the pad 105 to the plate 103.

A manifold 109 is connected to flexible elastomeric tubes 110. Threaded fittings 111 received in threaded holes 112 in the respective vacuum buttons 101 are connected to the tubes 110. A vacuum is drawn through passage 113 in each vacuum button 101 to hold the label LL.

Other embodiments or modifications of the invention will suggest themselves to those skilled in the art, and all such of these as come within the spirit of this invention are included within its scope as best defined by the appended claims.

I claim:

1. A label applicator for use in a label applying machine having means for supporting a source of labels releasably adhered to a carrier web, means for dispensing labels from the carrier web, and an actuator for the label applicator, the label applicator comprising: a mounting plate having a series of holes corresponding to labels of at least two different sizes, a resilient applicator pad having a lower surface, the pad having holes located in relation to at least one size of label and generally aligned with selected holes in the mounting plate, a set of vacuum buttons connectable to a vacuum source, each vacuum button having a head for contacting the lower surface of the resilient pad, the set of vacuum buttons being movably mounted in the holes in the pad and in the selected holes in the plate corresponding to one size of label for holding the dispensed labels by vacuum, and the vacuum buttons being movable along with the resilient pad as the resilient pad is compressed.

2. A label applicator as defined in claim 1, wherein each vacuum button comprises a first button portion having a head for contacting the plate and a second button portion connected to the first button portion having the head for contacting the pad, the plate and the pad being disposed between the heads.

3. A label applicator as defined in claim 2, wherein the first and second button portions have connecting through-holes.

4. A label applicator as defined in claim 2, wherein the first button portion and second button portion are threadably connected.

5. A label applicator as defined in claim 1, including means for yieldably holding the pad and the plate together at at least one or more places spaced from the vacuum buttons.

6. A label applicator as defined in claim 5, wherein the holding means includes other buttons identical to the vacuum buttons but the other buttons are not connected to any vacuum source.

7. A label applicator for use in a label applying machine having means for supporting a source of labels releasably adhered to a carrier web, means for dispensing labels from the carrier web, and an actuator for the label applicator, the label applicator comprising: a mounting plate, a resilient applicator pad adjacent the mounting plate and having a lower surface, holes in the mounting plate, holes in the pad aligned with holes in the mounting plate, vacuum buttons movably mounted in the selected holes in the mounting plate and in aligned holes in the pad, each vacuum button having a head for contacting the lower surface of the resilient pad, the number of holes in the mounting plate being greater than the number of vacuum buttons to enable the vacuum buttons to be positioned according to the size of the label to be applied, and the vacuum buttons being movable along with the resilient pad as the resilient pad is compressed.

8. Method of making a label applicator for a label applying machine, comprising the steps of: providing a plate having a series of holes corresponding to labels of at least two different sizes, providing a resilient applicator pad having a lower surface, making holes through the pad in a pattern related to at least one size of label and in general alignment with selected holes in the plate, providing a set of vacuum buttons, each vacuum button having a head for contacting the lower surface of the resilient pad, and movably mounting the vacuum buttons in the selected holes in the plate and in holes in the pad aligned therewith so that the vacuum buttons move along with the resilient pad as the resilient pad is compressed.

9. Method as defined in claim 8, including holding the plate and the resilient pad together with fasteners using holes in the plate and holes in the pad which are spaced from the vacuum buttons.

* * * * *

UNITED STATES PATENT AND TRADEMARK OFFICE

CERTIFICATE OF CORRECTION

PATENT NO. : 5,753,072

DATED : May 19, 1998

INVENTOR(S) : Bruce E. Taylor

It is certified that error appears in the above-indentified patent and that said Letters Patent is hereby corrected as shown below:

On title page, change the middle initial of the inventor from "W." to --E.--

On title page, References Cited, "5,435,862 7/1995 Williams et al" has been omitted.

Signed and Sealed this

Twenty-ninth Day of December, 1998

*Attest:*

*Attesting Officer*

BRUCE LEHMAN

*Commissioner of Patents and Trademarks*